US011207229B2

(12) United States Patent
Fu et al.

(10) Patent No.: US 11,207,229 B2
(45) Date of Patent: Dec. 28, 2021

(54) CARE BED COMBINING WHEELCHAIR

(71) Applicant: YoFa Biotechnology Co., LTD., New Taipei (TW)

(72) Inventors: Wei-Han Fu, New Taipei (TW); Chiu-Ming Lee, New Taipei (TW)

(73) Assignee: YOFA BIOTECHNOLOGY CO., LTD., New Taipei (TW)

( * ) Notice: Subject to any disclaimer, the term of this patent is extended or adjusted under 35 U.S.C. 154(b) by 303 days.

(21) Appl. No.: 16/142,972

(22) Filed: Sep. 26, 2018

(65) Prior Publication Data

US 2019/0091079 A1 Mar. 28, 2019

(30) Foreign Application Priority Data

Sep. 27, 2017 (TW) ..... 106133123

(51) Int. Cl.

| | |
|---|---|
| ***A61G 5/00*** | (2006.01) |
| ***A61G 7/05*** | (2006.01) |
| ***A61G 5/10*** | (2006.01) |
| ***A61G 7/015*** | (2006.01) |
| ***A61G 5/12*** | (2006.01) |
| ***A61G 7/02*** | (2006.01) |
| ***A61G 7/16*** | (2006.01) |

(52) U.S. Cl.

CPC ..... *A61G 5/006* (2013.01); *A61G 5/1002* (2013.01); *A61G 5/125* (2016.11); *A61G 5/128* (2016.11); *A61G 7/015* (2013.01); *A61G 7/02* (2013.01); *A61G 7/0518* (2016.11); *A61G 7/165* (2016.11); *A61G 5/1067* (2013.01)

(58) Field of Classification Search

CPC ..... A61G 5/006; A61G 7/165; A61G 5/125; A61G 7/0518; A61G 5/128; A61G 5/1002; A61G 7/015; A61G 7/02; A61G 5/1067

See application file for complete search history.

(56) References Cited

U.S. PATENT DOCUMENTS

| | | | | |
|---|---|---|---|---|
| 4,987,620 A * | 1/1991 | Sharon | ..... | A61G 5/006 5/600 |
| 6,272,702 B1 * | 8/2001 | Uchida | ..... | A61G 5/006 5/600 |
| 6,584,629 B2 * | 7/2003 | Tsuji | ..... | A61G 5/125 5/618 |

(Continued)

FOREIGN PATENT DOCUMENTS

| | | | | |
|---|---|---|---|---|
| CN | 205795942 U * | 12/2016 | ..... | A61G 7/015 |

*Primary Examiner* — Nicholas F Polito
*Assistant Examiner* — George Sun
(74) *Attorney, Agent, or Firm* — Muncy, Geissler, Olds & Lowe, P.C.

(57) ABSTRACT

The invention discloses a care bed including a bed frame and a wheelchair. A head panel, a tail panel, a foldable first lateral connecting portion and a second lateral connecting portion of the bed frame constitute an accommodating space of the bed frame. The bed frame has a notch formed at the folded first lateral connecting portion. The wheelchair is moved by the carriage base into the accommodating space through the notch. The backrest, the first armrest, the second armrest, the leg-rest and the footrest of the wheelchair are regulated into a co-plane with the seat to constitute a mattress. The mattress fits the accommodating space of the bed frame.

8 Claims, 6 Drawing Sheets

(56) References Cited

U.S. PATENT DOCUMENTS

| | | | | |
|---|---|---|---|---|
| 8,474,075 | B2 * | 7/2013 | Kawakami | A61G 5/006 5/618 |
| 2011/0196562 | A1 * | 8/2011 | Kume | A61G 5/006 701/23 |
| 2014/0196207 | A1 * | 7/2014 | Enriquez | A61G 7/165 5/11 |
| 2014/0327232 | A1 * | 11/2014 | He | A61G 7/00 280/648 |
| 2015/0082537 | A1 * | 3/2015 | Ohta | A61G 5/125 5/2.1 |
| 2016/0128882 | A1 * | 5/2016 | Tsukada | A61G 5/125 5/613 |
| 2016/0128885 | A1 * | 5/2016 | Latney | A61G 5/128 5/613 |
| 2017/0086594 | A1 * | 3/2017 | Khandrika | A61G 5/1002 |
| 2020/0030168 | A1 * | 1/2020 | Park | A61G 7/053 |

* cited by examiner

CARE BED COMBINING WHEELCHAIR

CROSS-REFERENCE TO RELATED APPLICATION

This utility application claims priorities to Taiwan Application Serial Number 106133123, filed Sep. 27, 2017, which is incorporated herein by reference.

BACKGROUND OF THE INVENTION

1. Field of the Invention

The invention relates to a care bed, and in particular, to a care bed combining a wheelchair.

2. Description of the Prior Art

Most of current care beds are fixed mattresses, and are not considered for availability for patients with limited mobility and even those who are disabled. Therefore, when a caregiver handles a patient with limited mobility or a disabled person from a care bed to a wheelchair, the caregiver may be physically exhausted and may even be injured.

At present, no good solution for a care bed combining a wheelchair has been proposed.

SUMMARY OF THE INVENTION

Accordingly, one scope of the invention is to provide a care bed combining a wheelchair. The care bed according to the invention can help a caregiver to provide good care for a patient, can also save the caregiver's enormous amounts of time and effort, and can also protect the caregiver from being injured.

A care bed according to a preferred embodiment of the invention includes a bed frame and a wheelchair. The bed frame defines a plane, and includes a head panel, a tail panel, a foldable first lateral connecting portion and a second lateral connecting portion. The foldable first lateral connecting portion is respectively connected to the head panel and the tail panel. The second lateral connecting portion is opposite to the foldable first lateral connecting portion, and respectively connected to the head panel and the tail panel. The head pane, the tail panel, the foldable first lateral connecting portion and the second lateral connecting portion constitute into an accommodating space of the bed frame. When a portion of the foldable first lateral connecting portion is folded parallel to the plane, the bed frame has a notch formed at the folded first lateral connecting portion. The wheelchair includes a carriage base, a seat, a backrest, a first armrest, a second armrest, a leg-rest, and a footrest. The seat is mounted on the carriage base. The backrest is pivotally connected to the seat. The first armrest is pivotally connected to a first edge of the backrest. The second armrest is pivotally connected to a second edge of the backrest. The leg-rest is pivotally connected to the seat. The footrest is pivotally connected to the leg-rest. The wheelchair is capable of being moved by the carriage base into the accommodating space of the bed frame through the notch. The backrest is capable of being folded downward to be parallel to the seat. The first armrest and the second armrest are capable of being folded downward to be parallel to the seat and the backrest. The leg-rest and the footrest are capable of being folded upward to be parallel to the seat. Thereby, the backrest, the first armrest, the second armrest, the leg-rest and the footrest of the wheelchair are regulated into a co-plane with the seat to constitute a mattress which permits a person to lie flat. The mattress fits the accommodating space of the bed frame.

Further, the care bed according to the preferred embodiment of the invention also includes a first docking device mounted on the second lateral connecting portion. The wheelchair also includes a second docking device mounted on a side of the seat and configured to mate with the first docking device. When the wheelchair is moved into the accommodating space, the wheelchair is capable of combining with the bed frame by mating the first docking device with the second docking device.

In one embodiment, the backrest can be erected relative to the seat. The leg-rest can be erected downward relative to the seat. The footrest can be erected upward relative to the leg-rest. The first armrest and the second armrest can be erected relative to the backrest. Thereby, the person sits on the wheelchair.

In one embodiment, the seat thereon has a through-hole.

Further, the care bed according to the preferred embodiment of the invention also includes a first supporting member being mounted on the head panel and protruding toward the accommodating space. The first support member is for supporting a front edge of the backrest of the wheelchair in a state of the mattress.

Further, the care bed according to the preferred embodiment of the invention also includes a second supporting member being mounted on the tail panel and protruding toward the accommodating space. The second support member is for supporting the footrest and a portion of the leg-rest adjacent to the footrest of the wheelchair in the state of the mattress.

Further, the care bed according to the preferred embodiment of the invention also includes a first power connector component mounted on the second lateral connecting portion. The wheelchair also includes a second power connector component mounted on the side of the seat and configured to mate with the first power connector component. When the wheelchair is moved into the accommodating space of the bed frame, the first power connector component connects to the second power connector component.

Further, the bed frame of the care bed according to the preferred embodiment of the invention also includes a first guard rail member and a second guard rail member. The first guard rail member is detachably fixed to the first lateral connecting portion. The second guard rail member is fixed to the second lateral connecting portion.

Distinguishable from the prior arts, the care bed according to the invention includes a bed frame and a wheelchair. The wheelchair of the invention can be converted into a mattress that fits the bed frame, or can be converted into a general wheelchair state for transporting patients.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 3:
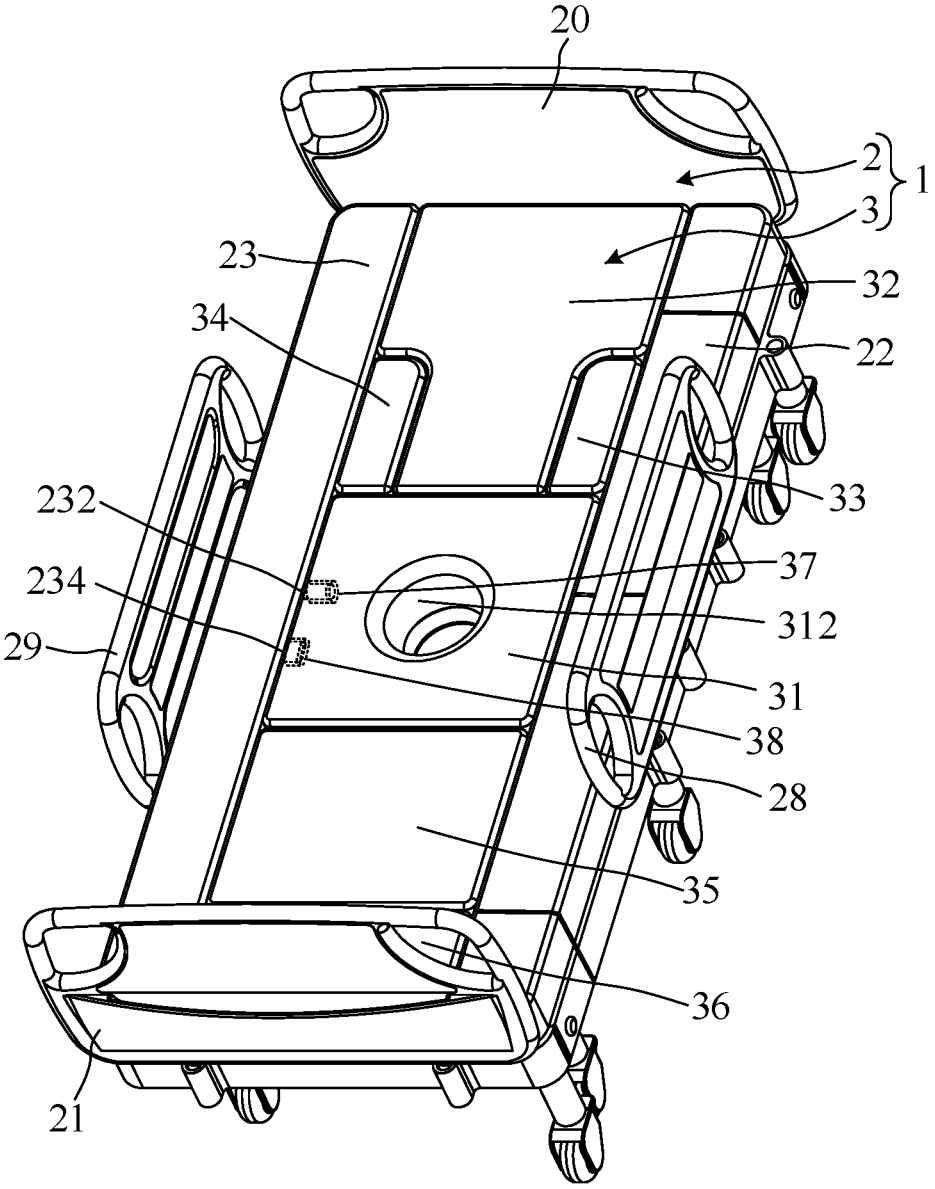
FIG. 3 is another perspective view of the care bed according to the preferred embodiment of the invention.
Figure 4:
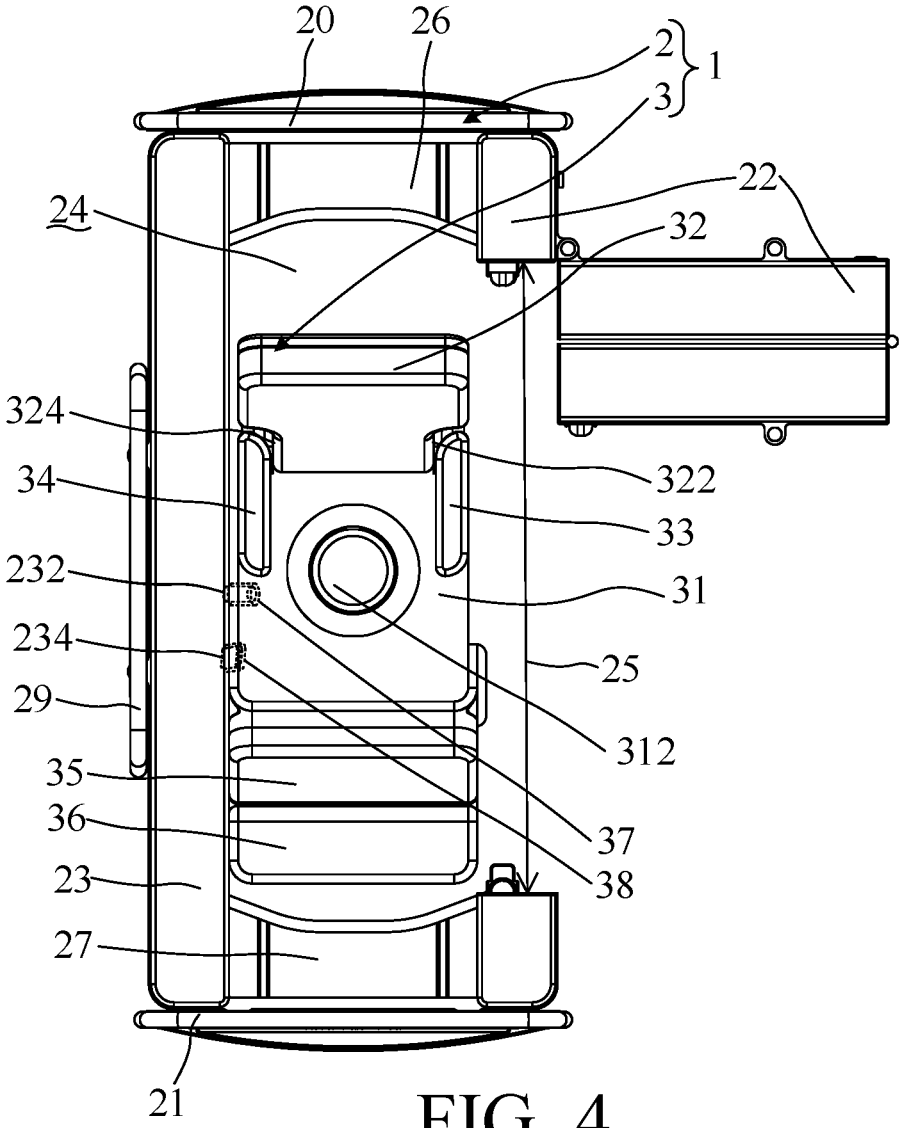
FIG. 4 is a top plant view of the care bed according to the preferred embodiment of the invention.
Figure 5:
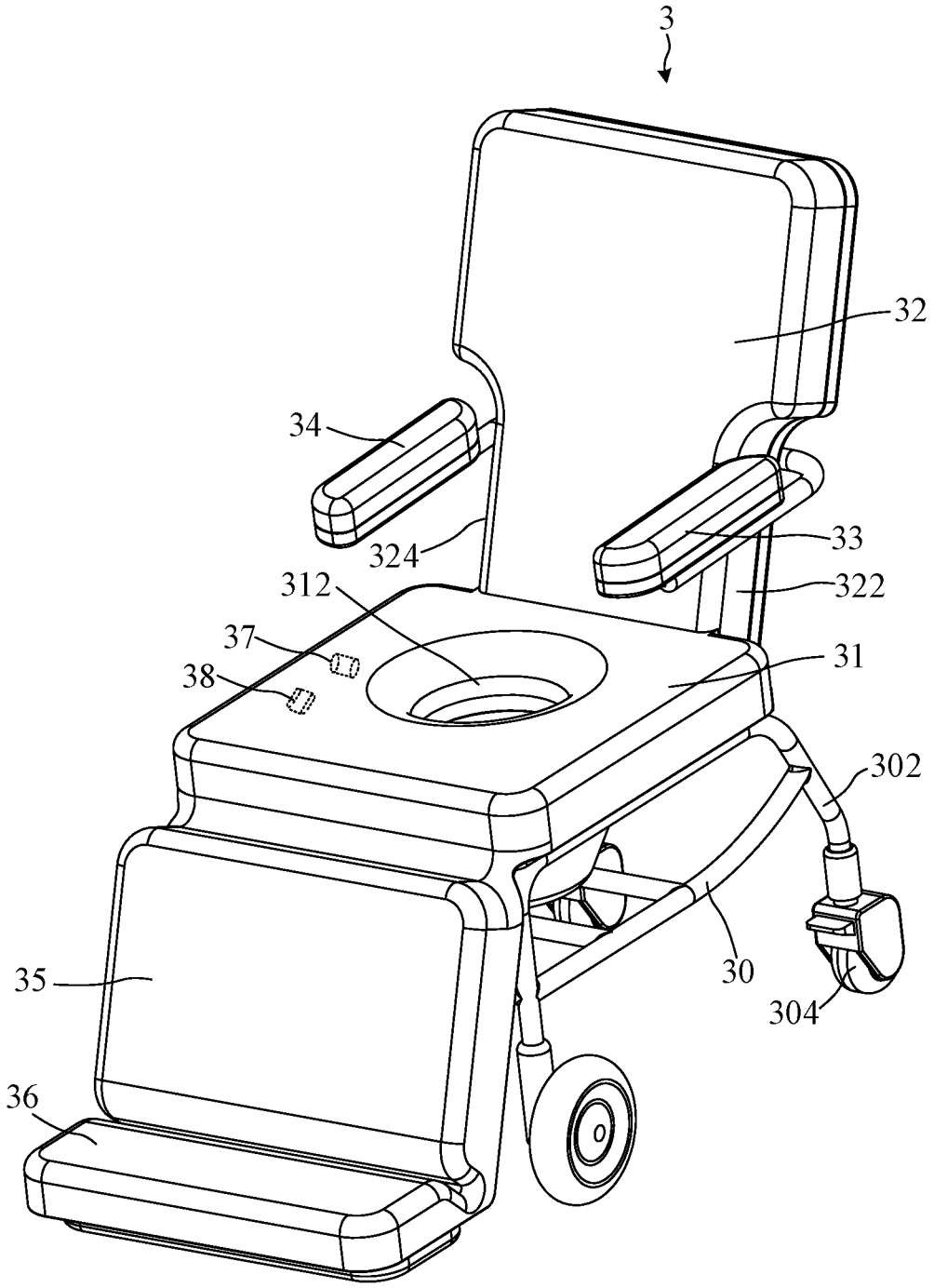
FIG. 5 is a perspective view of a wheelchair, an essential component of the care bed according to the preferred embodiment of the invention.
Figure 6:
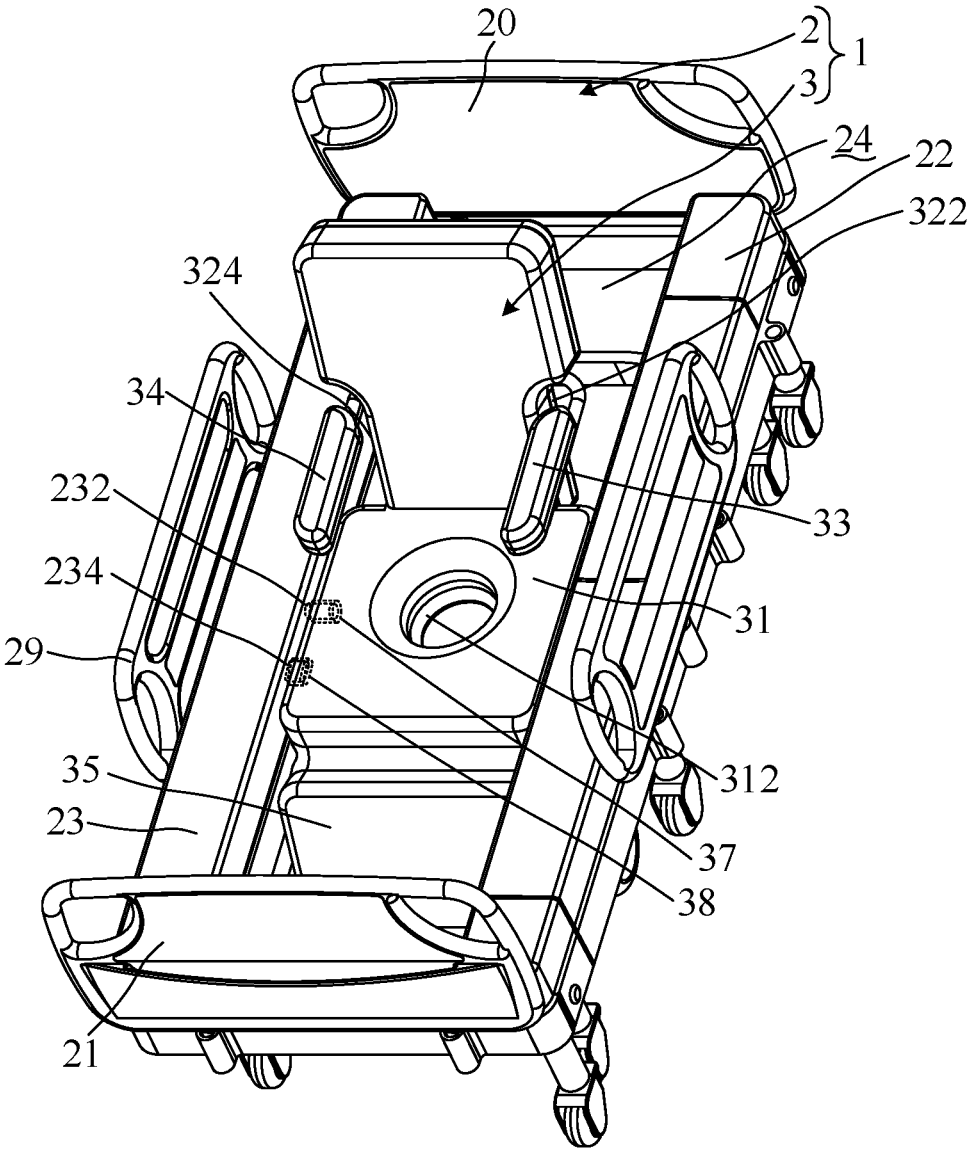
FIG. 6 is another perspective view of the care bed according to the preferred embodiment of the invention.

Referring to FIGS. 1 to 6, those drawings schematically illustrate a care bed 1 according to a preferred embodiment of the invention. FIGS. 1, 2, 3 and 6 are respectively perspective views of the care bed 1 in different operating states according to the preferred embodiment of the invention. FIG. 4 is a top plant view of the care bed 1 according to the preferred embodiment of the invention. FIG. 5 is a perspective view of a wheelchair 3, an essential component of the care bed 1 according to the preferred embodiment of the invention.

As shown in FIGS. 1, 2, 3, 4 and 6, the care bed 1 according to the preferred embodiment of the invention includes a bed frame 2 and the wheelchair 3.

The bed frame 2 defines a plane, and includes a head panel 20, a tail panel 21, a foldable first lateral connecting portion 22 and a second lateral connecting portion 23.

The foldable first lateral connecting portion 22 is respectively connected to the head panel 20 and the tail panel 21. The second lateral connecting portion 23 is opposite to the foldable first lateral connecting portion 22, and respectively connected to the head panel 20 and the tail panel 21.

In particular, the head pane, the tail panel 21, the foldable first lateral connecting portion 22 and the second lateral connecting portion 23 constitute into an accommodating space 24 of the bed frame 2. When a portion of the foldable first lateral connecting portion 22 is folded parallel to the plane, the bed frame 2 has a notch 25 formed at the folded first lateral connecting portion 22.

As shown in FIG. 5, the wheelchair 3 includes a carriage base 30, a seat 31, a backrest 32, a first armrest 33, a second armrest 34, a leg-rest 35, and a footrest 36.

The seat 31 is mounted on the carriage base 30. The carriage base 30 includes four legs 302 and wheels 304 mounted on the four legs 302, respectively. The carriage base 30 of the wheelchair 3 shown in FIG. 5 has architecture of manual pushing. However, the wheelchair 3 of the invention is not limited thereto. The carriage base 30 of the invention can also be equipped with a motor to drive the wheelchair 3 to move.

The backrest 32 is pivotally connected to the seat 31. The first armrest 33 is pivotally connected to a first edge 322 of the backrest 32. The second armrest 34 is pivotally connected to a second edge 324 of the backrest 32. The leg-rest 35 is pivotally connected to the seat 31. The footrest 36 is pivotally connected to the leg-rest 35.

Figure 1:
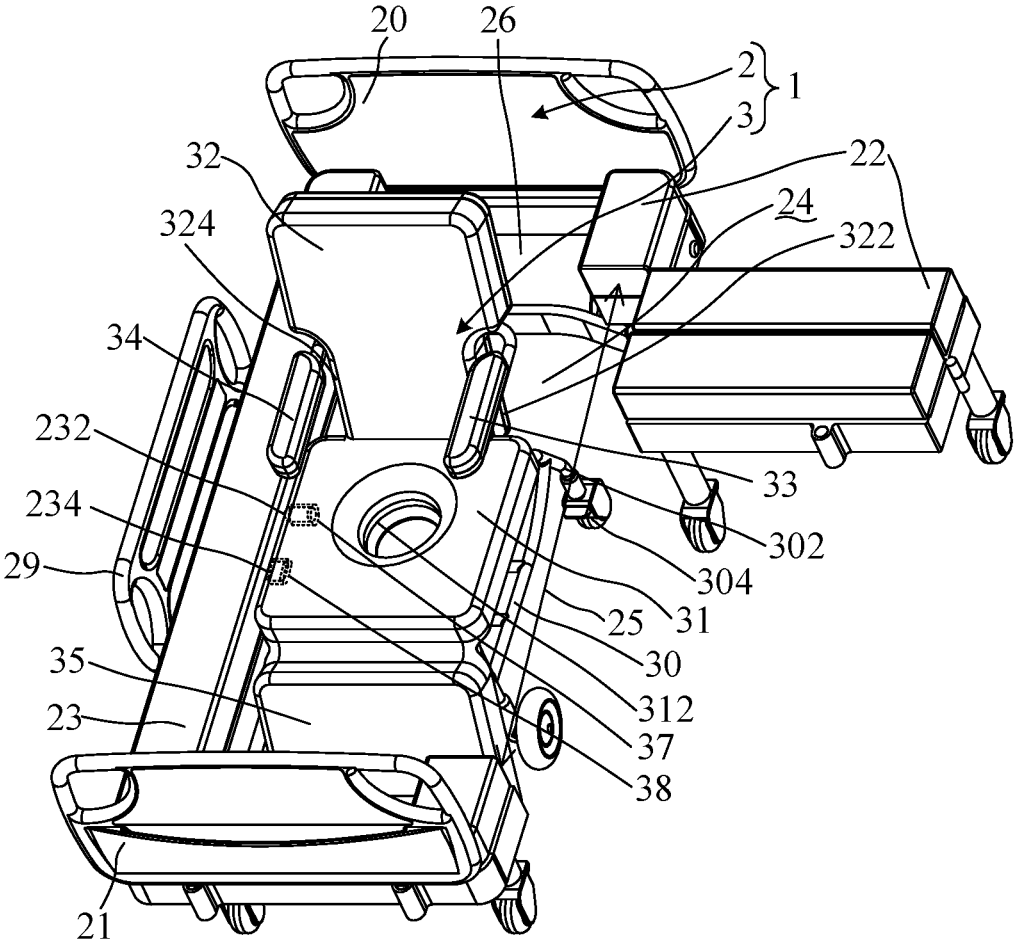
FIG. 1 is a perspective view of a care bed according to a preferred embodiment of the invention.
Figure 2:
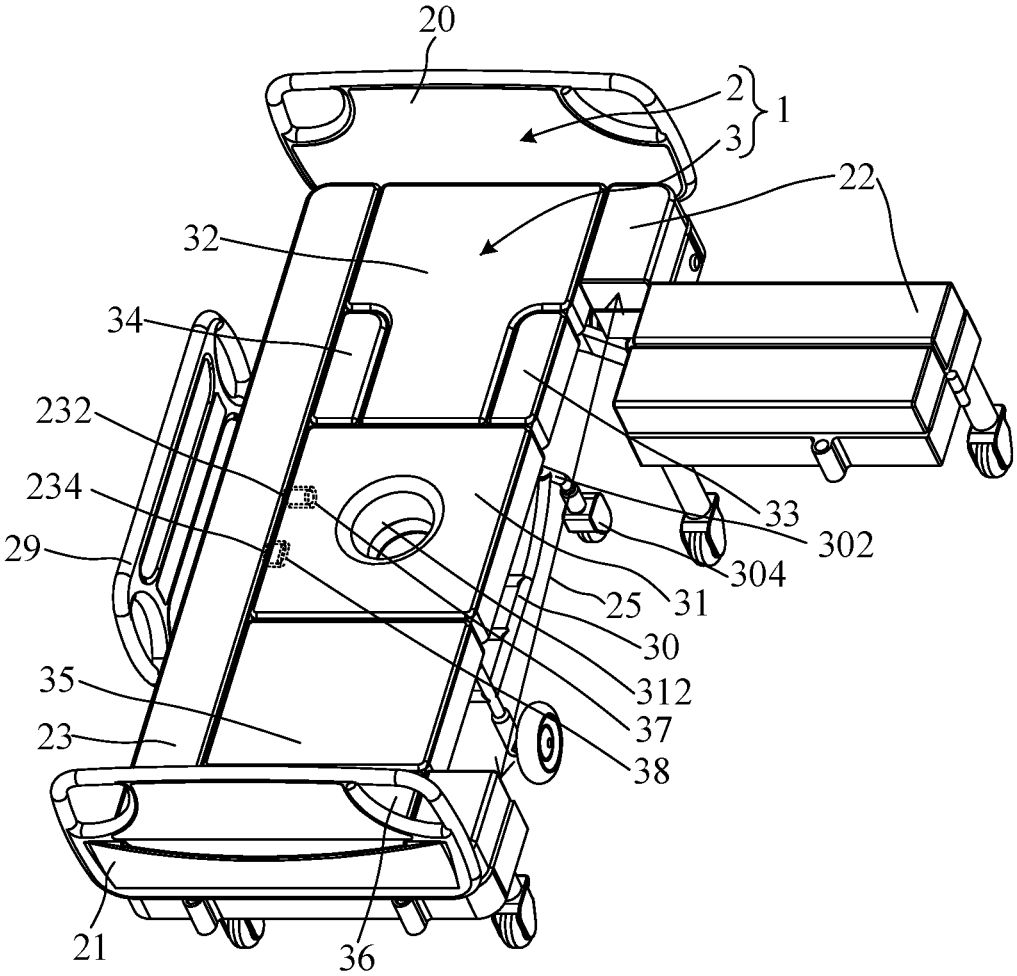
FIG. 2 is another perspective view of the care bed according to the preferred embodiment of the invention.

As shown in FIG. 1, the wheelchair 3 can be moved by the carriage base 30 into the accommodating space 24 of the bed frame 2 through the notch 25 of the bed frame 2.

In particular, the backrest 32 can be folded downward to be parallel to the seat 31. The first armrest 33 and the second armrest 34 can be folded downward to be parallel to the seat 31 and the backrest 32. The leg-rest 35 and the footrest 36 can be folded upward to be parallel to the seat 31. Thereby, the backrest 32, the first armrest 33, the second armrest 34, the leg-rest 35 and the footrest 36 of the wheelchair 3 are regulated into a co-plane with the seat 31 to constitute a mattress which permits a person to lie flat. The mattress fits the accommodating space 24 of the bed frame 2. As shown in FIG. 3, the foldable first lateral connecting portion 22 is again connected to the head panel 20 and the tail panel 21, respectively, to close the notch 25 of the bed frame 2.

Further, the care bed 1 according to the preferred embodiment of the invention also includes a first docking device 232 mounted on the second lateral connecting portion 23. The wheelchair 3 also includes a second docking device 37 mounted on a side of the seat 31 and configured to mate with the first docking device 232. When the wheelchair 3 is moved into the accommodating space 24, the wheelchair 3 can combine with the bed frame 2 by mating the first docking device 232 with the second docking device 37. In one embodiment, the first docking device 232 can be a stud, and the second docking device 37 can be a hole mating with the stud, but are not limited thereto.

In one embodiment, the backrest 32 can be erected relative to the seat 31. The leg-rest 35 can be erected downward relative to the seat 31. The footrest 36 can be erected upward relative to the leg-rest 35. The first armrest 33 and the second armrest 34 can be erected relative to the backrest 32. Thereby, the person sits on the wheelchair 3. The wheelchair 3 according to the invention can be erected within the accommodating space 24 of the bed frame 2, as shown in FIGS. 1 and 4. The wheelchair 3 according to the invention can also be erected after being removed from the accommodating space 24 of the bed frame 2, as shown in FIG. 5.

In one embodiment, the seat 31 thereon has a through-hole 312. The caregiver can dispose a potty or an automatic dejecta cleaning machine on the carriage base 30 and under the through hole 312, so that the patient's urine can be easily cleaned.

Further, the care bed 1 according to the preferred embodiment of the invention also includes a first supporting member 26. The first supporting member 26 is mounted on the head panel 20, and protrudes toward the accommodating space 24. The first support member 26 functions in supporting a front edge of the backrest 32 of the wheelchair 3 in a state of the mattress.

Further, the care bed 1 according to the preferred embodiment of the invention also includes a second supporting member 27. The second supporting member 27 is mounted on the tail panel 21, and protrudes toward the accommodating space 24. The second support member 27 functions in supporting the footrest 36 and a portion of the leg-rest 35 adjacent to the footrest 36 of the wheelchair 3 in the state of the mattress.

Further, the care bed 1 according to the preferred embodiment of the invention also includes a first power connector component 234. The first power connector component 234 is mounted on the second lateral connecting portion 23. The wheelchair 3 also includes a second power connector component 38. The second power connector component 38 is mounted on the side of the seat 31, and configured to mate with the first power connector component. When the wheelchair 3 is moved into the accommodating space 24 of the bed frame 2, the first power connector component 234 can be connected to the second power connector component 38. The bed frame 2 according to the preferred embodiment of the invention also includes a power plug (not shown in figures) electrically connected to the first power connector component 234. The power plug also extends out of the head panel 20, and provides an electric connection for an external power source. If the carriage base 30 of the wheelchair 3 is electrically powered and has a battery, or the automatic dejecta cleaning machine disposed on the carriage base 30 has a battery, the battery can be electrically connected to the second power connector component 38 and the external power source through the first power connector component 234 and the power plug to be charge by the external power source.

Further, the bed frame 2 of the care bed 1 according to the preferred embodiment of the invention also includes a first guard rail member 28 and a second guard rail member 29. The first guard rail member 28 is detachably fixed to the first lateral connecting portion 22. The second guard rail member 29 is fixed to the second lateral connecting portion 23. As shown in FIG. 1, the first guard rail member 28 is first detached, and then the foldable first lateral connecting portion 22 can be folded. The wheelchair of the invention can be converted into a mattress that fits the bed frame 2, or can be converted into a general wheelchair state for transporting patients.

With above detailed description of the preferred embodiments, it will be apparent that the care bed according to the invention includes a bed frame and a wheelchair. The care bed according to the invention can help a caregiver to provide good care for a patient, can also save the caregiver's enormous amounts of time and effort, and can also protect the caregiver from being injured.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A care bed, comprising:

a bed frame, capable of alternatively being in an open state or a closed state, defining a plane and comprising:

a head panel;

a tail panel;

a foldable first lateral connecting portion, respectively connected to the head panel and the tail panel; and a second lateral connecting portion, opposite to the foldable first lateral connecting portion and respectively connected to the head panel and the tail panel, wherein the head panel, the tail panel, the foldable first lateral connecting portion and the second lateral connecting portion constitute into an accommodating space of the bed frame, when the bed frame is in the open state, a portion of the foldable first lateral connecting portion is folded parallel to the plane defined by the bed frame, the bed frame has a notch being formed at the folded first lateral connecting portion and adjacent to the tail panel, and the second lateral connecting portion and the tail panel are not moved relative to the head panel, when the bed frame is in the closed state, the notch formed at the foldable first side connecting portion is closed; and a wheelchair, comprising:

a carriage base, wherein an occupied space of the carriage base being less than the accommodating space of the bed frame;

a seat, mounted on the carriage base;

a backrest, pivotally connected to the seat;

a first armrest, pivotally connected to a first edge of the backrest;

a second armrest, pivotally connected to a second edge of the backrest;

a leg-rest, pivotally connected to the seat; and a footrest, pivotally connected to the leg-rest, wherein a first width of the accommodating space is larger than a second width of the seat plus a third width of the footrest;

wherein the wheelchair is capable of being moved in an erected posture rather than a tilt posture by the carriage base into the accommodating space through the notch, the backrest is capable of being folded downward to be parallel to the seat, the first armrest and the second armrest are capable of being folded downward to be parallel to the seat and the backrest, the leg-rest and the footrest are capable of being folded upward to be parallel to the seat, whereby the backrest, the first armrest, the second armrest, the leg-rest and the footrest of the wheelchair are regulated into a co-plane with the seat to constitute the whole of a mattress which permits a person to lie flat, the mattress fits the accommodating space of the bed frame.

2. The care bed of claim 1, wherein the bed frame further comprises a first docking device mounted on the second lateral connecting portion, the wheelchair further comprises a second docking device mounted on a side of the seat and configured to mate with the first docking device, when the wheelchair is moved into the accommodating space, the wheelchair is capable of combining with the bed frame by mating the first docking device with the second docking device.

3. The care bed of claim 2, wherein the backrest is capable of being erected relative to the seat, the leg-rest is capable of being erected downward relative to the seat, the footrest is capable of being erected upward relative to the leg-rest, the first armrest and the second armrest are capable of being erected relative to the backrest, whereby the person sits on the wheelchair.

4. The care bed of claim 2, wherein the seat thereon has a through-hole.

5. The care bed of claim 2, wherein the bed frame further comprises a first lower platform being mounted on the head panel and protruding toward the accommodating space, the first support member is configured to support a front edge of the backrest of the wheelchair in a state of the mattress.

6. The care bed of claim 5, wherein the bed frame further comprises a second lower platform being mounted on the tail panel and protruding toward the accommodating space, the second support member is configured to support the footrest and a portion of the leg-rest adjacent to the footrest of the wheelchair in the state of the mattress.

7. The care bed of claim 2, wherein the bed frame further comprises a first power connector component mounted on the second lateral connecting portion, the wheelchair further comprises a second power connector component mounted on the side of the seat and configured to mate with the first power connector component, when the wheelchair is moved into the accommodating space, the first power connector component connects to the second power connector component.

8. The care bed of claim 2, wherein the bed frame further comprises a first guard rail member and a second guard rail member, the first guard rail member is detachably fixed to the first lateral connecting portion, and the second guard rail member is fixed to the second lateral connecting portion.

* * * * *